United States Patent [19]

Smith

[11] Patent Number: 4,658,441

[45] Date of Patent: Apr. 21, 1987

[54] ONE PIECE THUMB SUPPORT AND PROTECTOR

[76] Inventor: Steven A. Smith, P.O. Box 416, Grover City, Calif. 93433

[21] Appl. No.: 808,632

[22] Filed: Dec. 13, 1985

[51] Int. Cl.[4] ..... A41D 13/08

[52] U.S. Cl. ..... 2/16; 2/20; 2/21; 2/161 R

[58] Field of Search ..... 2/16, 20, 21, 161 A, 2/162, 163, 164

[56] References Cited

U.S. PATENT DOCUMENTS

| | | | |
|---|---|---|---|
| 2,949,610 | 8/1960 | Lutsky | 2/16 |
| 3,146,463 | 9/1964 | Wargo | 2/20 |
| 3,533,407 | 10/1970 | Smith | 2/20 |
| 3,598,408 | 8/1971 | Klose | 2/20 |
| 3,896,498 | 7/1975 | Pang | 2/20 |
| 3,903,546 | 9/1975 | Rhee | 2/16 |
| 4,047,250 | 9/1977 | Norman | 2/16 |
| 4,374,439 | 2/1983 | Norman | 2/20 |
| 4,400,829 | 8/1983 | Willis | 2/16 |
| 4,519,097 | 5/1985 | Chappell et al. | 2/16 |
| 4,531,241 | 7/1985 | Berger | 2/20 |

FOREIGN PATENT DOCUMENTS

| | | | |
|---|---|---|---|
| 278428 | 10/1927 | United Kingdom | 2/16 |

*Primary Examiner*—Louis K. Rimrodt
*Assistant Examiner*—Mary A. Ellis
*Attorney, Agent, or Firm*—Jerry N. Lulejian

[57] ABSTRACT

Disclosed is a thumb support for the human hand comprising a support piece having a cradle portion installable around the thenar eminence and the metacarpophalangeal joint of the thumb and a tab portion wrappable over the thumb/index web space. When the cradle portion and tab portion are properly installed, they create a frustoconically shaped cone portion which acts to enclose the metacarpophalangeal joint of the thumb and isolate the index finger and the thumb and support the metacarpophalangeal joint of the thumb.

2 Claims, 3 Drawing Figures

ONE PIECE THUMB SUPPORT AND PROTECTOR

BACKGROUND OF THE INVENTION

The present invention relates to thumb supports and particularly to thumb supports which are not attached to the wrist and which act to isolate the thumb from the index finger.

The applicant knows of several inventions in the area of thumb, digit or limb protection and/or support. Specifically, the following is a list of patent references known to the applicant in this field:

J. C. Cox, et al. U.S. Pat. No. 1,471,948
M. K. Young U.S. Pat. No. 2,523,606
George Primiano, et al. U.S. Pat. No. 4,524,464
Allan Finnieston U.S. Pat. No. 4,417,570
Robert L. Blackwood U.S. Pat. No. 4,489,716
Gertrude Franzl U.S. Pat. No. 4,103,682
M. Dunat French Pat. No. 415.701

The French patent reference relates to a finger brace, the Finieston reference relates to a lower arm brace, the Blackwood reference relates to an elbow brace and the Franzl reference relates to a finger brace. None of these references is directly related to the thumb support of the present invention. The French Patent, the Finiestone U.S. Patent, the Blackwood, et al. U.S. Patent and the Franzl U.S. Patent do not relate to thumb supports but are offered as anatomical immobilizing devices of general interest.

The Cox reference discloses a thumb protector which uses a splint attached to the upper part of the thumb and to the wrist. This thumb protector immobilizes the patient's wrist and does not effectively prevent the adduction of the thumb as does the present invention. In addition, the Cox reference does not disclose or contemplate the use of a tab portion wrapped over the thumb/index web space to limit the adduction of the thumb.

The Young reference simply discloses a splint member which is attached around the wrist. This splint member does not effectively prevent the adduction of the thumb as does the present invention. The Young reference also fails to disclose or contemplate the use of a tab wrapped over the thumb/index web space to prevent the adduction of the thumb.

The Primiano reference discloses a brace which cradles the thumb but which does not effectively prevent adduction of the thumb as does the present invention. In addition, the Primiano reference does not disclose a tab portion wrapped over the thumb/index web space as does the present invention.

The present invention is the first to employ a tab portion wrapable over the thumb/index web space together with a cradle portion which cradles the thenar eminence and the metacarpophalangeal joint. These two portions together form a frusto-conically shaped cone portion which effectively immobilizes the metacarpophalangeal joint. None of the prior art teaches or suggests the use of the tab portion of the present invention in conjunction with a cradle for supporting the metacarpophalangeal joint.

SUMMARY OF THE INVENTION

The present invention is a thumb support for the human hand generally comprising a support piece having a cradle portion installable at least partially around the thenar eminence and the metacarpophalangeal joint. The support piece also has a tab portion which is wrapable over the thumb/index web space and when so wrapped acts to at least partially enclose the cradle portion. The installed support piece creates a frustoconically shaped protective cone portion. The cone portion acts to enclose at least the metacarpophalangeal joint and acts to isolate the index finger from the thumb.

The present invention also includes any convenient means for anchoring the cradle portion of the support piece to the hand such as velcro straps. It also includes a means for securing the tap portion in its position as wrapped over the thumb/index web space which typically also involves velcro straps.

The thumb support of the present invention is primarily concerned with supporting the metacarpophalangeal joint but may be used to support other or additional joints of the thumb.

DETAILED DESCRIPTION OF THE INVENTION

Figure 2:
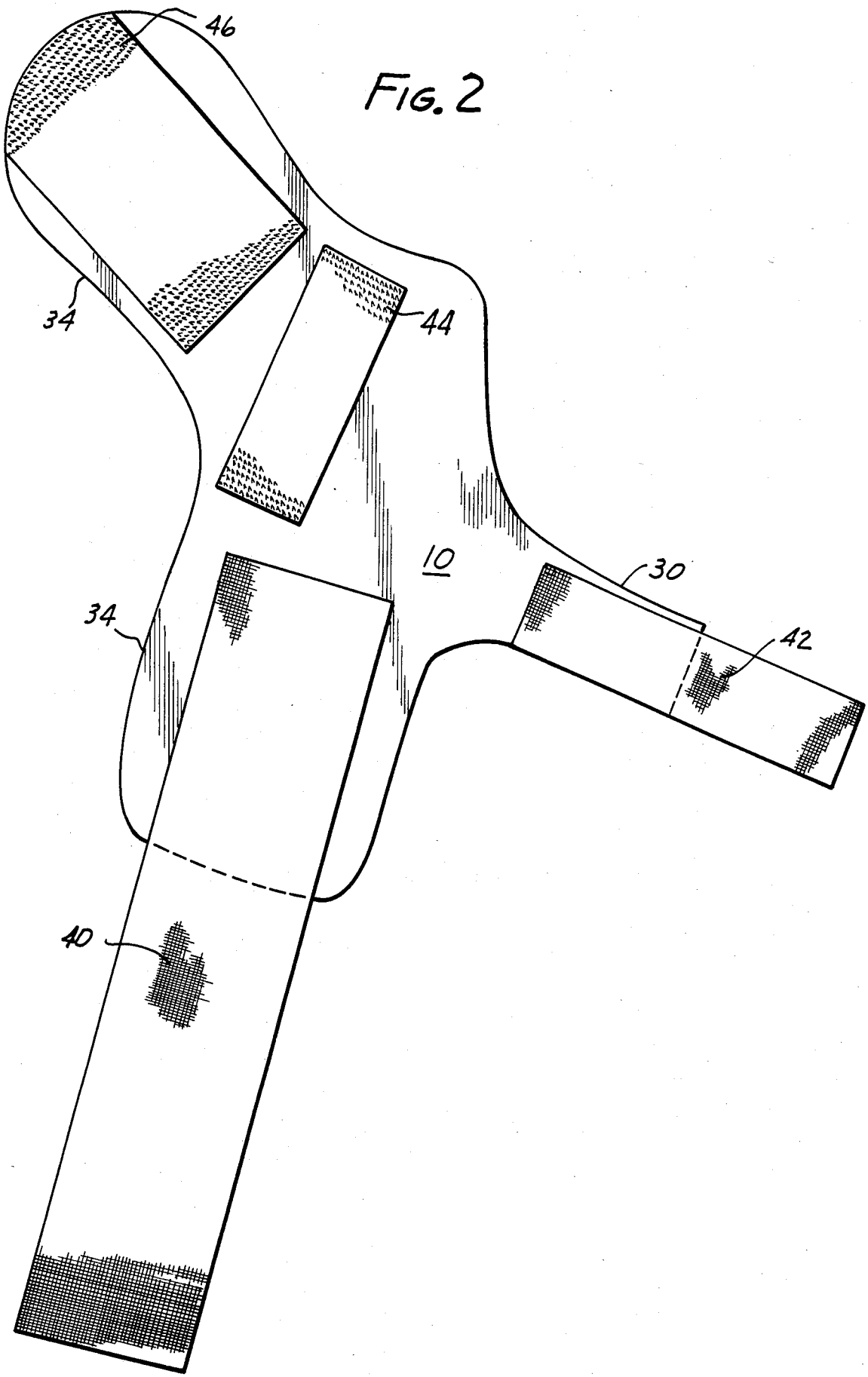
FIG. 2 is a top view of the support piece of the present invention.

Referring first to FIG. 2, the present invention is comprised of a support piece 10. This support piece has peripheral dimensions substantially as shown in FIG. 2. Of course, FIG. 2 is not drawn to scale. The size of the support piece 10 can be adjusted for different sized hands as necessary.

The support piece is preferably made from low density polyethylene which is preferrably 0.030 inches thick. This material gives the support piece 10 lateral rigidity but allows portions of the support piece 10 to be wrapped around the human hand 20 (of FIGS. 1A and 1B). This material also protects the thumb from injury caused by bumping against foreign objects.

Figure 1A:
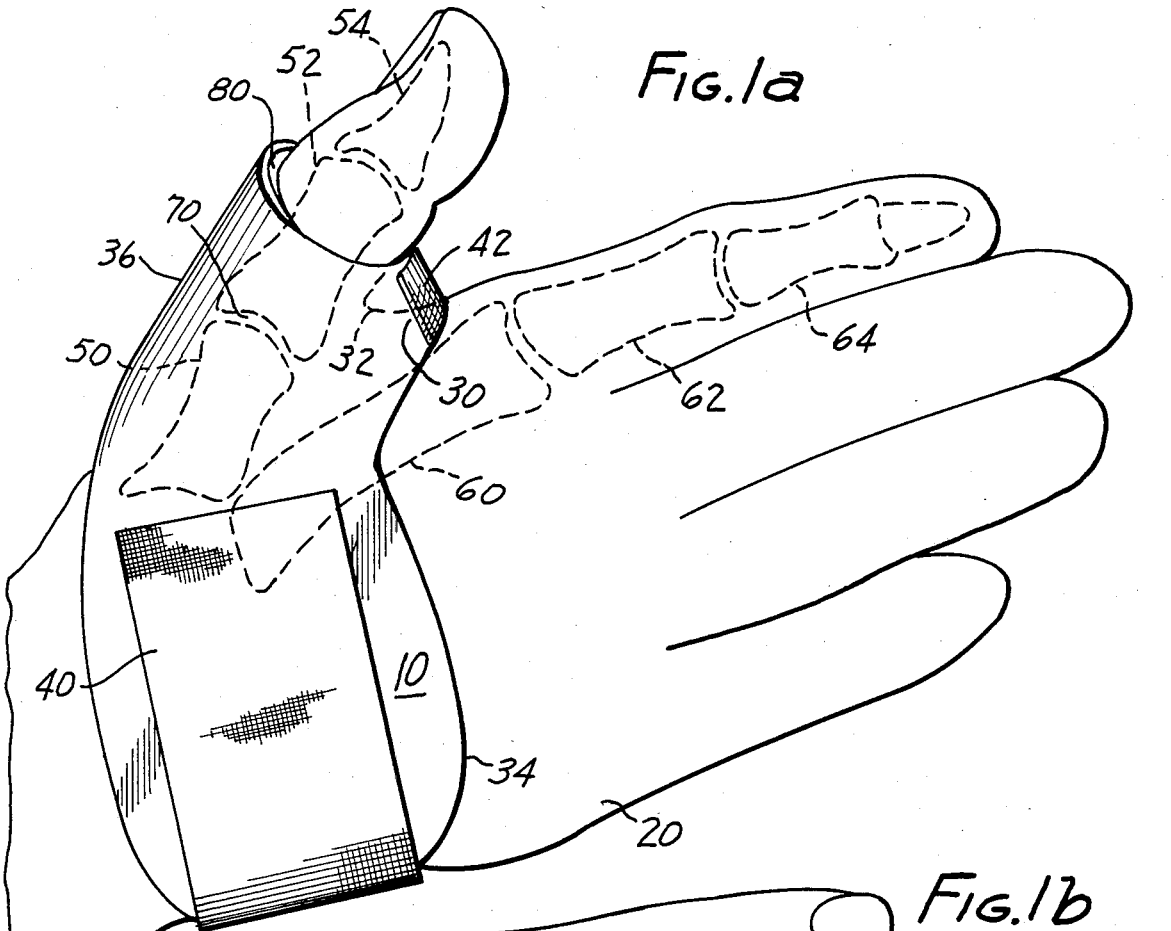
FIG. 1A is a palmar view of a left human hand with the invention installed thereon.
Figure 1B:
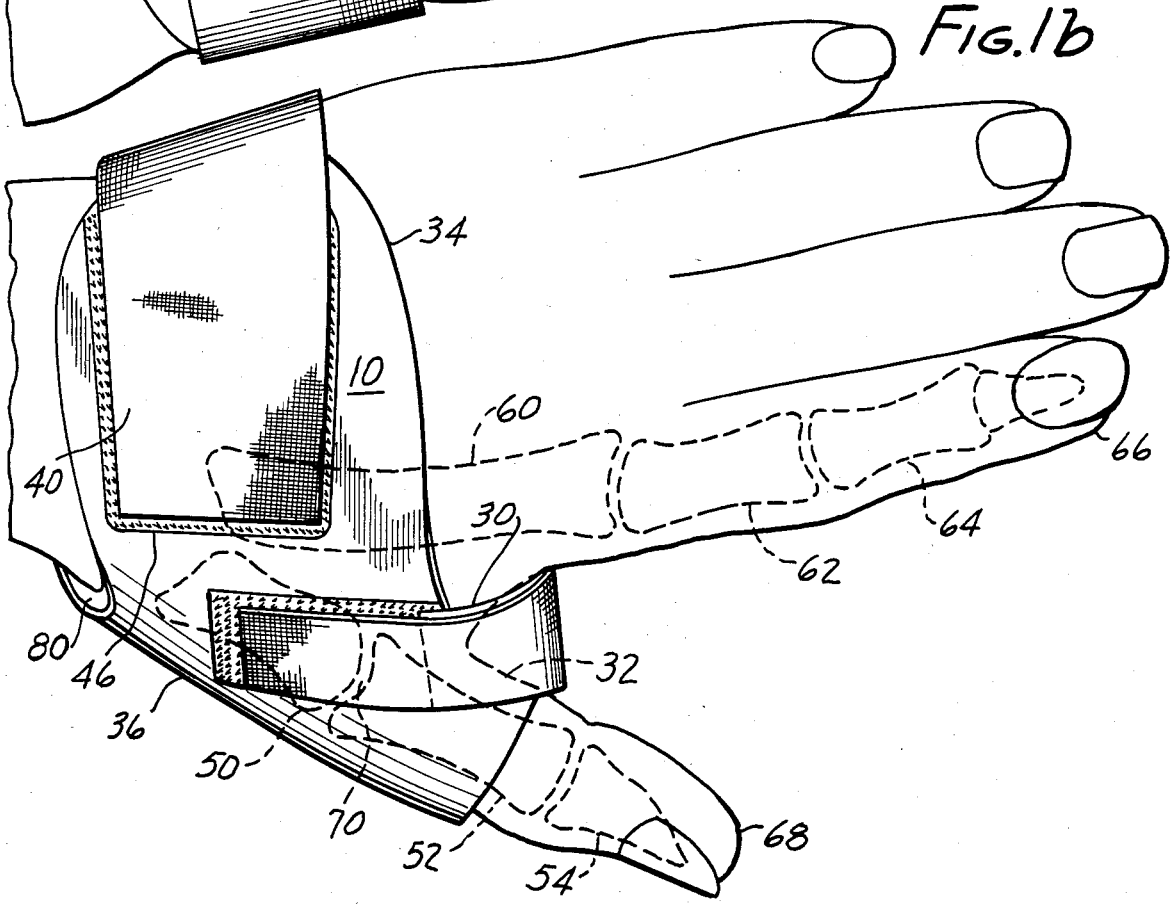
FIG. 1B is a dorsal view of a left human hand with the invention installed thereon.

The support piece 10 has a tap portion 30, which when installed on the human hand 20 (of FIGS. 1A and 1B), wraps over the thumb/index web space 32 (of FIGS. 1A and 1B). The support piece 10 also has outstretched fins 34, which when installed on the human hand 20 (of FIGS. 1A and 1B) comprise a cradle portion 36 (shown in FIGS. 1A and 1B). The support piece 10 is secured on the hand 20 (of FIGS. 1A and 1B) via velcro straps 40, 42, 44 and 46. The preferred placement of the velcro straps 40, 42, 44 and 46 are shown in FIG. 2.

Referring now to FIG. 1A, a palmar view of the human left hand 20 is shown. The first metacarpal 50, the proximal phalanx 52 and the distal phalanx 54 of the thumb 68 are shown in dotted lines. In addition, the second metacarpal 60, the proximal palanx 62 and the middle phalanx 64 of the left index finger 66 are also shown in dotted lines.

A palmar view of the support piece 10 as properly installed on the left human hand 20 is also shown in FIG. 1A. The two fins 34 (only one of which is shown in FIG. 1A) are used in conjunction with velcro straps 40 and 46 to anchor the support piece 10 to the left human hand 20. The support piece 10 when so installed comprises a cradle portion 36 which acts to cradle at least the metacarpophalangeal joint 70 of the thumb 68.

In order to prevent significant adduction of the thumb 68, the present invention has employed the use of the tab portion 30 of the support piece 10 which is shown wrapped over the thumb/index web space 32 of the left human hand 20 in FIG. 1A.

Referring specifically to FIG. 1B, the tab portion 30 is shown wrapped over the thumb/index web space 32 and partially over the cradle portion 36 of the support piece 10. Velcro straps 42 and 44 act to secure the tab portion 30 in its position and wrapped over the thumb-/index web space 32.

The support piece 10 preferably has a lining 80 (shown only in FIG. 1A) of one-quarter inch thick foam rubber for comfort.

When the tab portion 30 is secured in its proper position and the cradle portion 36 is anchored to the left hand 20 as shown in FIGS. 1A and 1B, the support piece 10 comprises a frustoconically shaped cone around the metcarpophalangeal joint 70 thus preventing significant adduction, abduction, flexion or extension of the thumb 68.

The preceding disclosure of the preferred embodiment of the present invention is for illustrative purposes only and shall not be considered to define the scope of the present invention. Instead, the scope of the present invention shall be defined by the following claims and their equivalents.

I claim:

1. A thumb support for the human hand, comprising:

a support piece defining a plane and comprising:

a cradle portion installable at least partially around the thenar eminence and the metacarpophalangeal joint of the thumb;

a tab portion wrappable over the thumb/index web space and when so wrapped acting to at least partially enclose the cradle portion, the tab portion being of sufficient rigidity to substantially prevent the thumb from moving in a plane defined by the thumb and an index finger of the human hand;

a means for anchoring the cradle portion of the support piece to the hand;

a means for securing the tab portion in its position as wrapped over the thumb/index web space; and, the cradle portion when so installed and the tab portion so wrapped comprise a frusto-conically shaped cone portion, which cone portion acts to enclose at least the metacarpophalangeal joint or the thumb and acts to isolate the index finger and the thumb.

2. The thumb support in accordance with claim 1 in which the periphery of the plane defined by the support piece is substantially as shown in FIG. 2.

* * * * *